US010726710B1

(12) United States Patent
Dieterle et al.

(10) Patent No.: US 10,726,710 B1
(45) Date of Patent: Jul. 28, 2020

(54) SYSTEM AND METHOD FOR NOTIFYING A USER OF A SENSOR IN A COMPROMISED STATE

(71) Applicant: Dell Products L.P., Round Rock, TX (US)

(72) Inventors: Christian Dieterle, Round Rock, TX (US); Terry L. Matula, Austin, TX (US); Maxwell S. Andrews, Novato, CA (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/534,071

(22) Filed: Aug. 7, 2019

(51) Int. Cl.
*G08B 29/02* (2006.01)
*G08B 5/36* (2006.01)

(52) U.S. Cl.
CPC ..... *G08B 29/02* (2013.01); *G08B 5/36* (2013.01)

(58) Field of Classification Search
CPC ..... G08B 29/02; G08B 5/36
USPC ..... 340/506
See application file for complete search history.

(56) References Cited

U.S. PATENT DOCUMENTS

2011/0258429 A1* 10/2011 Hsu ..... H04W 52/0229 713/100
2018/0316835 A1* 11/2018 Files ..... G06K 9/228
2018/0365467 A1* 12/2018 Robison ..... G06K 9/0004
2019/0281558 A1* 9/2019 Wu ..... G06F 21/57

* cited by examiner

*Primary Examiner* — Ojiako K Nwugo
(74) *Attorney, Agent, or Firm* — Baker Botts L.L.P.

(57) ABSTRACT

Methods, systems, and computer programs for sending a sensor enable signal to a sensor of an information handling system via a light source, the light source electrically coupling the host controller to the sensor; receiving a feedback signal from the sensor, the feedback signal indicating whether the sensor is in an on state or in an off state; determining, based on the feedback signal, whether the sensor is in the on state or in the off state; determining whether the light source is in an illuminated state or in an unilluminated state; and in response to determining that the sensor is in the on state and that the light source is in the unilluminated state: causing a first notification to be displayed to a user of the information handling system, the first notification indicating to the user that the sensor is in a compromised state.

20 Claims, 5 Drawing Sheets

SYSTEM AND METHOD FOR NOTIFYING A USER OF A SENSOR IN A COMPROMISED STATE

BACKGROUND

Field of the Disclosure

This disclosure relates generally to information handling systems, and in particular to notifying a user of an information handling system of a sensor in a compromised state.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

SUMMARY

Innovative aspects of the subject matter described in this specification may be embodied in a method for notifying a user of an information handling system of a sensor in a compromised state, where the method includes sending, by a host controller, a sensor enable signal to a sensor of an information handling system via a light source, the light source electrically coupling the host controller to the sensor; receiving, by the host controller, a feedback signal from the sensor, the feedback signal indicating whether the sensor is in an on state or in an off state; determining, based on the feedback signal, whether the sensor is in the on state or in the off state; determining whether the light source is in an illuminated state or in an unilluminated state; and in response to determining that the sensor is in the on state and that the light source is in the unilluminated state: causing a first notification to be displayed to a user of the information handling system, the first notification indicating to the user that the sensor is in a compromised state.

In one or more of the disclosed embodiments, the method further comprises: in response to determining that the sensor is in the off state and that the light source is in the illuminated state, causing the first notification to be displayed to the user of the information handling system.

In one or more of the disclosed embodiments, the compromised state comprises at least one of: a state in which the sensor is in the on state and the light source is in the unilluminated state; and a state in which the sensor is in the off state and the light source is in the illuminated state.

In one or more of the disclosed embodiments, the method further comprises: causing, by the host controller, the sensor to be in an electrically disabled state; and causing a second notification to be displayed to the user of the information handling system, the second notification indicating to the user that the sensor is in the electrically disabled state.

In one or more of the disclosed embodiments, the method further comprises: receiving, by the host controller, a request from a third-party application to access the sensor, the third-party application executing on the information handling system; and in response to receiving the request from the third-party application: refraining from sending the sensor enable signal to the sensor; sending a light source control signal to the light source, the light source control signal causing the light source to be in the illuminated state; and causing a third notification to be displayed to the user of the information handling system, the third notification indicating to the user that the sensor is in a requested state.

In one or more of the disclosed embodiments, the sensor of the information handling system is at least one of: an image sensor; and an audio sensor.

In one or more of the disclosed embodiments, the light source comprises a multi-color LED, where each color of the multi-color LED indicates at least one of: the sensor is in the on state; the sensor is in the compromised state; the sensor is in an electrically disabled state; and the sensor is in a requested state.

In one or more of the disclosed embodiments, the host controller and the sensor are electrically coupled in series with the light source.

In one or more of the disclosed embodiments, the method further comprises: causing, via a network of a computing environment, the first notification to be displayed to an administrator of the computing environment; and in response to causing the first notification to be displayed to the administrator: receiving, from the administrator, a second notification indicating that the sensor is in an electrically disabled state; and causing the second notification to be displayed to the user of the information handling system.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

Figure 1:
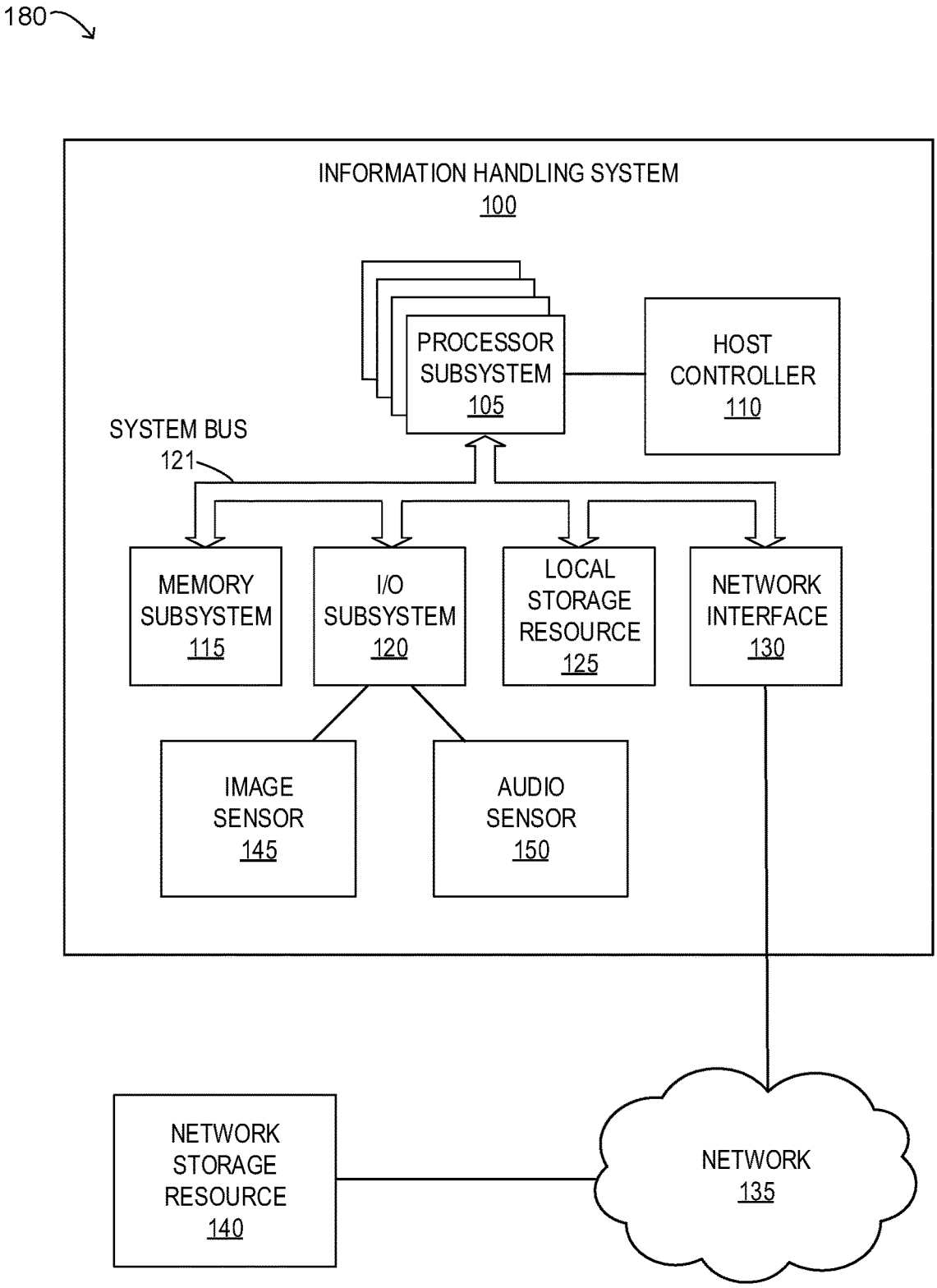
FIG. 1 illustrates a block diagram of selected elements of an embodiment of an information handling system.

This document describes a method and a system for notifying a user of an information handling system of a sensor in a compromised state. Specifically, this document describes sending, by a host controller, a sensor enable signal to a sensor of an information handling system via a light source, the light source electrically coupling the host controller to the sensor; receiving, by the host controller, a feedback signal from the sensor, the feedback signal indicating whether the sensor is in an on state or in an off state; determining, based on the feedback signal, whether the sensor is in the on state or in the off state; determining whether the light source is in an illuminated state or in an unilluminated state; and in response to determining that the sensor is in the on state and that the light source is in the unilluminated state: causing a first notification to be displayed to a user of the information handling system, the first notification indicating to the user that the sensor is in a compromised state.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-5 wherein like numbers are used to indicate like and corresponding parts.

Turning now to the drawings, FIG. 1 illustrates a block diagram depicting selected elements of an information handling system 100 in accordance with some embodiments of the present disclosure. In various embodiments, information handling system 100 may represent different types of portable information handling systems, such as, display devices, head mounted displays, head mount display systems, smart phones, tablet computers, notebook computers, media players, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems. Components of information handling system 100 may include, but are not limited to, a processor subsystem 105, which may comprise one or more processors, and system bus 121 that communicatively couples various system components to processor subsystem 105 including, for example, a memory subsystem 115, an I/O subsystem 120, a local storage resource 125, an embedded controller (EC) 190, and a network interface 130. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

As depicted in FIG. 1, processor subsystem 105 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 105 may interpret and/or execute program instructions and/or process data stored locally (e.g., in memory subsystem 115 and/or another component of information handling system). In the same or alternative embodiments, processor subsystem 105 may interpret and/or execute program instructions and/or process data stored remotely (e.g., in network storage resource 140).

Also in FIG. 1, memory subsystem 115 may comprise a system, device, or apparatus operable to retain and/or retrieve program instructions and/or data for a period of time (e.g., computer-readable media). Memory subsystem 115 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling system 100, I/O subsystem 120 may comprise a system, device, or apparatus generally operable to receive and/or transmit data to/from/within information handling system 100. I/O subsystem 120 may represent, for example, a variety of communication interfaces, graphics interfaces, video interfaces, user input interfaces, and/or peripheral interfaces. In various embodiments, I/O subsystem 120 may be used to support various peripheral devices, such as a touch panel, a display adapter, a keyboard, an accelerometer, a touch pad, a gyroscope, an IR sensor, a microphone, a sensor, or a camera, or another type of peripheral device. In the embodiment depicted in FIG. 1, I/O subsystem may include image sensor 145 and audio sensor 150.

As depicted in FIG. 1, host controller 110 may comprise a system, device, or apparatus operable to manage and support various peripheral I/O devices coupled to IHS 100. In particular, host controller 110 may be electrically coupled to image sensor 145 and audio sensor 150 such that host controller 110 can control configurations associated with image sensor 145 and audio sensor 150. For example, host controller 110 may control configurations associated with digital images recorded, or otherwise detected, by image sensor 145. Host controller 110 can manage image sensor 145 sensitivity or exposure elements such as ISO, aperture, and/or shutter speed, for example. In addition, host controller 110 can control configurations associated digital audio recorded, or otherwise detected, by audio sensor 150. In one embodiment, host controller 110 can send an enable signal to both image sensor 145 and audio sensor 150 such that image sensor 145 and audio sensor 150 may be selectively enabled/disabled for/from use. For example, if a user requests to use a camera of IHS 100, host controller 110 can send an image sensor enable signal to image sensor 145 to enable the camera for use. In contrast, if host controller 110 determines that the camera has been enabled in a compromised state (e.g., due to malicious tampering), host controller 110 may command circuitry associated with image sensor 145 to electrically decouple image sensor 145 from a power supply, thereby electrically disabling image sensor 145 from operation. In this way, host controller 110 can determine which peripheral I/O devices may be enabled for use and which peripheral I/O devices may be in a compromised state and, thereby, restricted from operation. In another embodiment, IHS 100 can send an enable signal to image sensor 145 and audio sensor 150.

In addition, host controller 110 can manage peripheral I/O devices such that a user of IHS 100 may be notified when a peripheral I/O device has been enabled. For example, host controller 110 can cause a light source, such as a light emitting diode (LED), to illuminate when a webcam has been enabled and begins to record digital images, thereby notifying the user that the webcam has been turned on. Conventionally, host controller 110 may include firmware logic used to communicate with, both, a driver associated with image sensor 145 and the light source such that host controller 110 can enable image sensor 145 and cause the light source to illuminate (i.e., to indicate that image sensor 145 has been enabled). However, such firmware logic may be vulnerable to malicious tampering or become otherwise compromised (e.g., due to a firmware bug or faulty update) such that image sensor 145 and audio sensor 150 may be enabled in a compromised state. For example, host controller 110 may enable image sensor 145 but may fail to cause the light source to illuminate. In this example, a webcam of IHS 100 may begin to record digital images of a user without notifying the user via the light source, placing the image sensor 145 in a compromised state. In a similar example, a microphone of IHS 100 may begin to record digital audio from a user without notifying the user via the light source, placing the audio sensor 150 in a compromised state. Therefore, host controller 110 may be electrically coupled to image sensor 145 and/or audio sensor 150 in series with a light source (e.g., incandescent light, fluorescent light, LED, multi-color LED, and the like) such that an enable signal can flow through the light source before reaching image sensor 145 and/or audio sensor 150. This ensures user privacy and data security in that a user can be consistently notified when a camera and/or microphone device begin recording, or otherwise detecting, digital images and/or digital audio. Furthermore, if host controller 110 determines that image sensor 145 and/or audio sensor 150 have been enabled without a light source notifying the user, host controller 110 can cause a notification to be displayed to the user indicating that image sensor 145 and/or audio sensor 150 have been enabled in a compromised state.

In one or more embodiments, an indicator such as an audible sound or alarm may be employed to notify a user when image sensor 145 and/or audio sensor 150 have been enabled for use. In particular, host controller 110 may be electrically coupled to image sensor 145 and/or audio sensor 150 in series with an electroacoustic transducer (e.g., a speaker) such that an enable signal can flow through the electroacoustic transducer before reaching image sensor 145 and/or audio sensor 150 thereby causing emission of an audible sound or alarm. In one or more embodiments, an indicator such as haptic feedback may be employed to notify a user when image sensor 145 and/or audio sensor 150 have been enabled for use. Specifically, host controller 110 may be electrically coupled to image sensor 145 and/or audio sensor 150 in series with a haptic feedback generator (e.g., a vibrating min motor disc) such that an enable signal can flow through the haptic feedback generator before reaching image sensor 145 and/or audio sensor 150 thereby causing haptic feedback to occur. In other embodiments, any suitable combination of audible notification, haptic notification, and/or light source notification may be employed to notify a user that an image sensor, audio sensor, or any other sensor of IHS 100 has been enabled for use. Host controller 110 is described in further detail with respect to FIGS. 2, 3, and 4.

As depicted in FIG. 1, audio sensor 150 may comprise a system, device, or apparatus operable to receive and convert sound waves into electrical signals such that the electrical signals may be processed by IHS 100. In particular, audio sensor 150 may be or include transducers used to convert acoustic pressure waves received from a user into electrical signals, such as a voltage, for example. In one embodiment, audio sensor 150 may be or include digital or analog circuitry configured to receive audio signals from a user such that the audio signals may be used by various applications executing on IHS 100. In one or more embodiments, audio sensor 150 may be or include a microphone.

As depicted in FIG. 1, image sensor 145 may comprise a system, device, or apparatus operable to receive and convert images into electrical signals. In particular, image sensor 145 may be or include a charge-coupled device (CCD) and/or complementary metal-oxide semiconductor (CMOS) image sensor configured to convert light into electrons such that IHS 100 may use the electrons to process a digital image. In one or more embodiments, image sensor 145 may be or include a digital camera.

As depicted in FIG. 1, processor subsystem 105 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data.

Local storage resource 125 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. Likewise, the network storage resource may comprise computer-readable media (e.g., hard disk drive, floppy disk drive, CD-ROM, and/or other type of rotating storage media, flash memory, EEPROM, and/or other type of solid state storage media) and may be generally operable to store instructions and/or data.

In one or more embodiments, EC 190 may be or include a microcontroller. For example, the microcontroller may be or include an 8051 microcontroller, an ARM Cortex-M (e.g., Cortex-M0, Cortex-M0+, Cortex-M1, Cortex-M3, Cortex-M4, Cortex-M7, etc.) microcontroller, a MSP430 microcontroller, an AVR (e.g., 8-bit AVR, AVR-32, etc.) microcontroller, a PIC microcontroller, a 68HC11 microcontroller, a ColdFire microcontroller, and a Renesas microcontroller, among others. In one or more embodiments, EC 190 may be or include one or more of a field programmable gate array (FPGA) and an application specific integrated circuit (ASIC), among others, configured, coded, and/or encoded with instructions in accordance with one or more of systems, flowcharts, methods, and/or processes described herein.

As depicted in FIG. 1, network interface 130 may be a suitable system, apparatus, or device operable to serve as an interface between information handling system 100 and a network 135. Network interface 130 may enable information handling system 100 to communicate over network 135 using a suitable transmission protocol and/or standard, including, but not limited to, transmission protocols and/or standards enumerated below with respect to the discussion of network 135. In some embodiments, network interface 130 may be communicatively coupled via network 135 to a network storage resource 140. Network 135 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 130 may enable wired and/or wireless communications (e.g., NFC or Bluetooth) to and/or from information handling system 100.

In particular embodiments, network 135 may include one or more routers for routing data between client information handling systems 100 and server information handling systems 100. A device (e.g., a client information handling system 100 or a server information handling system 100) on network 135 may be addressed by a corresponding network address including, for example, an Internet protocol (IP) address, an Internet name, a Windows Internet name service (WINS) name, a domain name or other system name. In particular embodiments, network 135 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, T1, T3, Fiber Optics, Wi-Fi, or a mobile network connection including GSM, GPRS, 3G, or WiMax.

Network 135 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 135 and its various components may be implemented using hardware, software, or any combination thereof.

Figure 2:
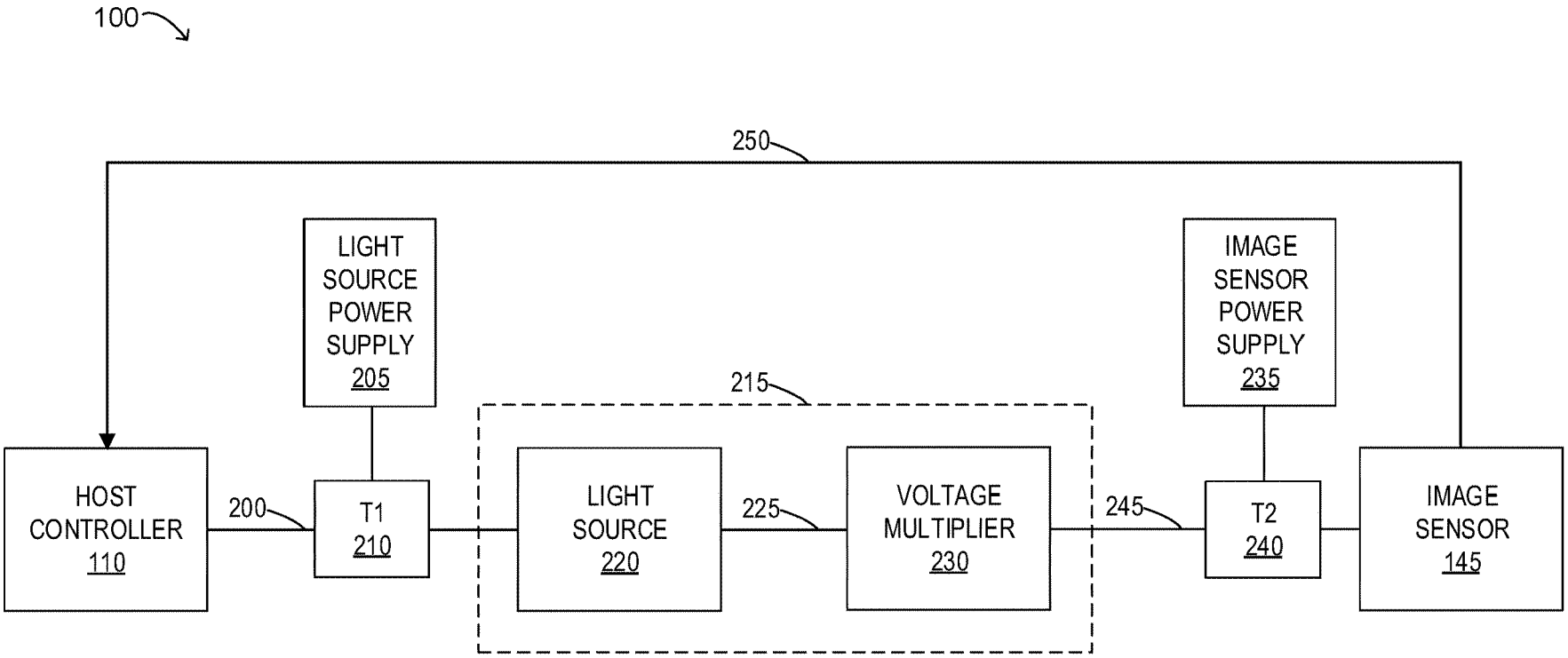
FIG. 2 illustrates a block diagram of selected elements of an embodiment for notifying a user of an information handling system of a sensor in a compromised state.

FIG. 2 illustrates a block diagram of selected elements of an embodiment for notifying a user of an information handling system of a sensor in a compromised state. In the embodiment illustrated in FIG. 2, IHS 100 includes a host controller 110, a light source power supply 205, a light source circuit 215, an image sensor power supply 235, an image sensor 145, and transistors T1 210 and T2 240. Light source circuit 215 further includes light source 220 and a voltage multiplier 230.

As depicted in FIG. 2, host controller 110 may be a suitable system, apparatus, or device operable to manage and support image sensor 145 and provide notification to a user of a compromised state. In particular, host controller 110 may be electrically coupled to image sensor 145 such that host controller 110 can manage configurations associated with image sensor 145 (e.g., sensor sensitivity, exposure, and the like). In the embodiment illustrated in FIG. 2, host controller 110 may be electrically coupled to image sensor 145 in series with light source 220, voltage multiplier 230, and transistors T1 210 and T2 240. In one embodiment, host controller 110 can send image sensor 145 an image sensor enable signal 200. Because host controller 110 and image sensor 145 are electrically coupled in series with light source 220, image sensor enable signal 200 may flow through light source 220 prior to reaching image sensor 145, thereby causing light source 220 to be in an illuminated state. Therefore, host controller 110 may provide notification (i.e., via light source 220) to a user of IHS 100 that image sensor 145 (e.g., a camera of IHS 100) will be enabled for recording, or otherwise detecting, digital images of the user and/or an environment of the user prior to becoming enabled.

In the embodiment illustrated in FIG. 2, transistors T1 210 and T2 240 may serve as switches (e.g., MOSFETS, BJTs, and the like) used to supply power to light source 220 and image sensor 145, respectively. In one embodiment, T1 210 can receive image sensor enable signal 200 from host controller 110 and can serve as a switch for providing power to light source 220. In particular, image sensor enable signal 200 may supply a voltage to a gate of T1 210 such that current may flow from light source power supply 205 through a channel of T1 210 (e.g., from a source to a drain) into light source 220, thereby causing light source 220 to be in an illuminated state. Similarly, T2 240 can receive light source circuit output voltage 245 from light source circuit 215 and can serve as a switch for providing power to image sensor 145. However, because light source 220 and image sensor 145 are electrically coupled in series, light source 220 may cause a voltage drop as current from light source power supply 205 flows through light source 220. Consequently, light source output voltage 225 may not provide the gate of T2 240 with an adequate voltage needed to power T2 240 and allow current to flow from image sensor power supply 235 to image sensor 145.

In one embodiment, voltage multiplier 230 may be or include an operational amplifier (op-amp) circuit electrically coupled to light source 220 in light source circuit 215.

Voltage multiplier 230 may be electrically coupled to light source 220 in series such that voltage multiplier 230 can receive light source output voltage 225 and can convert the lower light source output voltage 225 into a higher light source circuit output voltage 245 that may be adequate for providing power to T2 240. In particular, voltage multiplier 230 can convert the lower light source output voltage 225 into a higher light source circuit output voltage 245 (e.g., by an 8:1 ratio) such that light source circuit output voltage 245 may be received at a gate of T2 240, thereby providing power to T2 240 and allowing a current to flow from image sensor power supply 235 to image sensor 145.

In the embodiment illustrated in FIG. 2, host controller 110 can receive image sensor feedback signal 250 from image sensor 145 indicating whether image sensor 145 is in an on state or in an off state. That is, image sensor feedback signal 250 may be a binary signal used by host controller 110 to determine whether image sensor 145 is in an on state (e.g., a camera of IHS 100 is recording digital images). If host controller 110 determines that image sensor 145 is in the on state, host controller 110 may further determine whether light source 220 is in an illuminated state or in an unilluminated state. That is, upon determining that image sensor 145 has been turned on, host controller 110 may determine a state of light source 220 to ensure that light source 220 properly indicates to a user that a camera of IHS 100 is recording, or otherwise detecting, digital images of the user and/or an environment of the user.

If host controller 110 determines that image sensor 145 is in the on state (i.e., based on image sensor feedback signal 250) and that light source 220 is in the unilluminated state (e.g., based on light source output voltage 225 and/or light source circuit output voltage 245), host controller 110 may determine that image sensor 145 has been enabled in a compromised state. For example, a compromised state may exist as a result of malicious tampering with light source 220 causing image sensor 145 to be in the on state without causing light source 220 be in an illuminated state. Because host controller 110 and image sensor 145 are electrically coupled in series with light source 220, such malicious tampering may include hardwiring (e.g., using a jumper wire) the electric coupling between host controller 110 and image sensor 145 to create a short circuit that excludes light source 220. This short circuit excluding light source 220 may cause image sensor enable signal 200 to bypass light source 220 prior to reaching image sensor 145, which may cause image sensor 145 to be enabled in a compromised state. However, such malicious tampering exists in an analog domain (e.g., hardwiring the electric coupling), thereby excluding attempts at remote malicious tampering to place image sensor 145 in the compromised state. Upon determining that image sensor 145 has been enabled in a compromised state, host controller 110 may cause a notification to be displayed to the user accordingly.

In one embodiment, host controller 110 can notify a user of IHS 100 of a compromised state via a display of IHS 100. In one instance, host controller 110 may cause display of a message indicating to a user that image sensor 145 has been enabled to be in the on state without causing light source 220 to be in the illuminated state (i.e., a compromised state). In particular, host controller 110 may cause output of a stored bitmap that includes a message notifying the user of a compromised state. Host controller 110 may inject the bitmap into a video feed of an application executing on IHS 100 that utilizes the camera enabled in the compromised state. For example, a user of IHS 100 that may be using a webcam of IHS 100 for a chat application may receive a message overlay within a user interface of the chat application indicating that the webcam has been enabled in a compromised state. The message overlay may be visible to any and/or all additional users involved in the chat such that any and/or all additional users may identify the message and opt in/out of further involvement with the chat involving the camera in the compromised state. In one embodiment, the message may additionally instruct the user to contact a service administrator to identify a source of the compromised state and/or instruct the user to take IHS 100 to a manufacturer or business enterprise such that image sensor 145 can be repaired.

In one embodiment, host controller 110 may cause image sensor 145 to be in an electrically disabled state in response to determining that image sensor 145 has been enabled in a compromised state. That is, host controller 110 may disable a camera of IHS 100 that was enabled in a compromised state. In one embodiment, host controller 110 can electrically decouple image sensor power supply 235 from image sensor 145 (e.g., via T2 240), thereby causing image sensor 145 to be in the electrically disabled state. In one instance, host controller 110 may cause image sensor 145 to be in an electrically disabled state based on a threshold period of time in which image sensor 145 is in a compromised state. For example, if host controller 110 causes a notification to be displayed to a user via a display of IHS 100 indicating that image sensor 145 is in a compromised state, host controller 110 may set a timer and cause image sensor power supply 235 to be electrically decoupled from image sensor 145 once a threshold period of time has elapsed. In one embodiment, host controller 110 can electrically decouple image sensor power supply 235 from image sensor 145 by cutting power to T2 240. In another embodiment, an administrator may cause image sensor 145 to be in an electrically disabled state. In particular, host controller 110 may cause a notification of a compromised state to be displayed to an administrator of computing environment (e.g., via network 135). In response, host controller 110 can receive notification from the administrator indicating that image sensor 145 has been electrically disabled. Host controller 110 may further cause notification to be displayed to a user of IHS 100 indicating to the user that image sensor 145 is in the electrically disabled state. In one instance, host controller 110 may cause the notification to be displayed when image sensor 145 is electrically decoupled from image sensor power supply 235. In another embodiment, host controller 110 may cause the notification to be displayed to a user upon restart or reboot of IHS 100.

Figure 3:
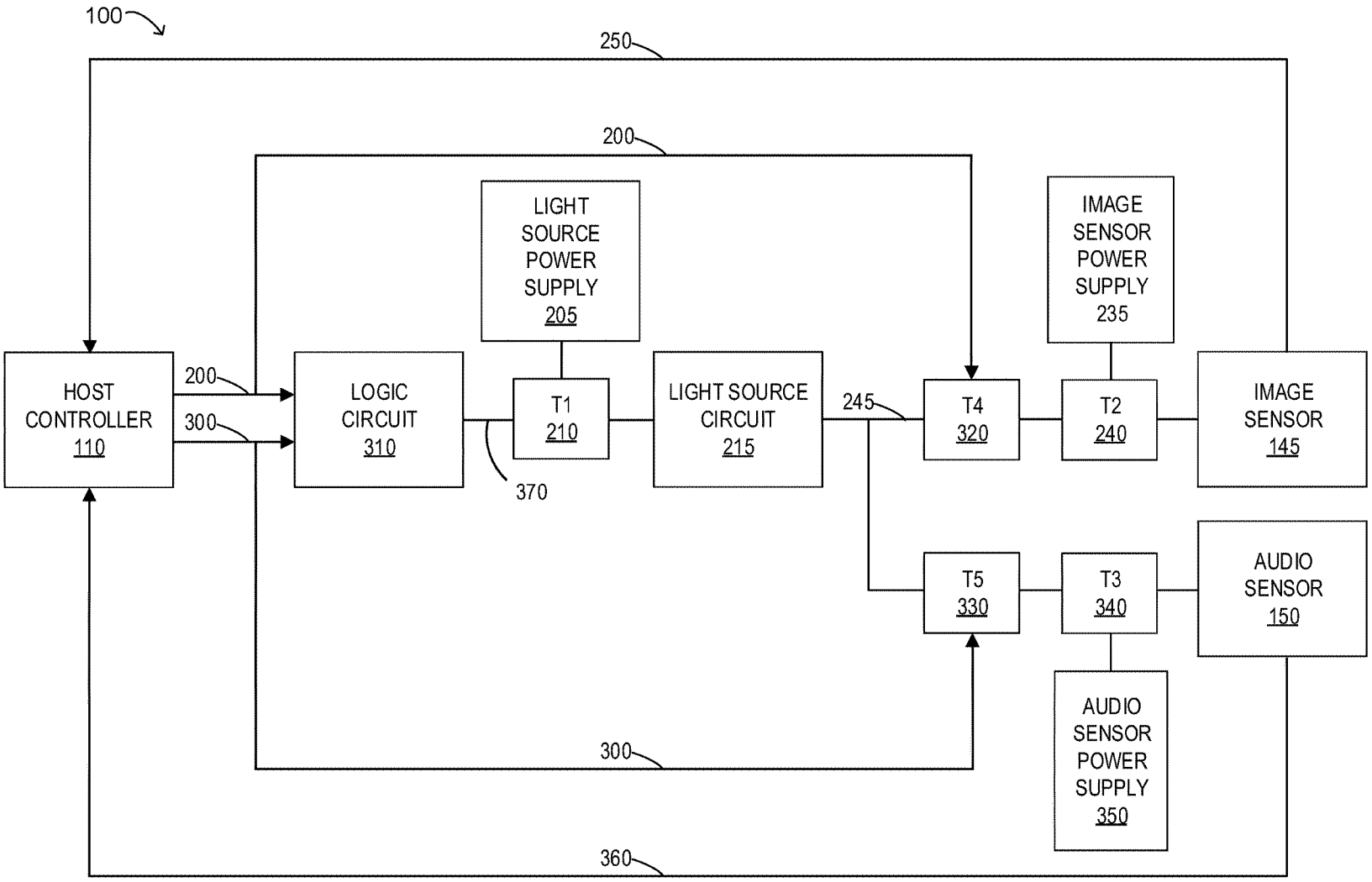
FIG. 3 illustrates a block diagram of selected elements of an embodiment for notifying a user of an information handling system of two sensors in a compromised state.

FIG. 3 illustrates a block diagram of selected elements of an embodiment for notifying a user of an information handling system of two sensors in a compromised state. In the embodiment illustrated in FIG. 3, IHS 100 includes a host controller 110, a logic circuit 310, a light source power supply 205, a light source circuit 215, an image sensor power supply 235, an image sensor 145, an audio sensor power supply 350, an audio sensor 150, and transistors T1 210, T2 240, T3 340, T4 320, and T5 330. Host controller 110 may be electrically coupled to image sensor 145 in series with logic circuit 310, light source circuit 215 (i.e., light source 220 and voltage multiplier 230), and transistors T1 210, T4 320, and T2 240. Host controller may further be electrically coupled to audio sensor 150 in series with logic circuit 310, light source circuit 215, and transistors T1 210, T5 330, and T3 340. As described with respect to FIG. 2, host controller 110 may cause image sensor 145 to be in an on state by sending image sensor 145 an image sensor enable signal 200. In the embodiment illustrated in FIG. 3, host controller may additionally cause audio sensor 150 to be in an on state by sending audio sensor 150 an audio sensor enable signal 300. Because host controller 110 and image sensor 145 are electrically coupled in series with light source 220, image sensor enable signal 200 may flow through light source 220 prior to reaching image sensor 145, thereby causing light source 220 to be in an illuminated state. Similarly, because host controller 110 and audio sensor 150 are electrically coupled in series with light source 220, audio sensor enable signal 300 may flow through light source 220 prior to reaching audio sensor 150, thereby causing light source 220 to be in the illuminated state. Therefore, host controller 110 may provide notification (i.e., via light source 220) to a user of IHS 100 that image sensor 145 (e.g., a camera of IHS 100) and/or audio sensor 150 (e.g., a microphone of IHS 100) will be enabled for recording, or otherwise detecting, digital information from the user and/or an environment of the user prior to becoming enabled.

In one embodiment, logic circuit 310 may receive image sensor enable signal 200 and/or audio sensor enable signal 300 and can send logic circuit output voltage 370 to T1 210. In one embodiment, logic circuit 310 may be or include one or more logic gates (e.g., AND gate, OR gate, and the like) such that logic circuit output voltage 370 may be sent in response to receiving either of image sensor enable signal 200 or audio sensor enable signal 300. That is, logic circuit 310 may receive image sensor enable signal 200 and/or audio sensor enable signal 300 and send logic circuit output voltage 370 to T1 210, thereby allowing current to flow through T1 210 from light source power supply 205 into light source circuit 215 as described with respect to FIG. 2.

In addition to being received by logic circuit 310, image sensor enable signal 200 may also be received at a gate of T4 320. Image sensor enable signal 200 may provide power to T4 320 such that T4 320 can allow a current of light source circuit output voltage 245 to flow from light source circuit 215 to a gate of T2 240 through T4 320. This current can provide power to the gate of T2 240, thus allowing a current to flow from image sensor power supply 235 to image sensor 145 through T2 240 causing image sensor 145 to be in an on state. However, if a current fails to flow through light source circuit 215, there will be no current to flow through T4 320 and consequently no power provided to the gate of T2 240. Therefore, despite host controller 110 sending image sensor enable signal 200, light source 220 may serve as a fuse that can restrict current from flowing into image sensor 145 (i.e., providing power to image sensor 145) if light source 220 is not in an illuminated state providing notification to a user that image sensor 145 will be enabled.

Similarly, audio sensor enable signal 300 may be received at a gate of T5 330. Audio sensor enable signal 300 may provide power to T5 330 such that T5 330 can allow a current of light source circuit output voltage 245 to flow from light source circuit 215 to a gate of T3 340 through T5 330. This current can provide power to the gate of T3 340, thus allowing a current to flow from audio sensor power supply 350 to audio sensor 150 through T3 340 causing audio sensor 150 to be in an on state. However, if a current fails to flow through light source circuit 215, there will be no current to flow through T5 330 and consequently no power provided to the gate of T3 340. Therefore, despite host controller 110 sending audio sensor enable signal 300, light source 220 may serve as a fuse that can restrict current from flowing into audio sensor 150 (i.e., providing power to audio sensor 150) if light source 220 is not in an illuminated state providing notification to a user that audio sensor 150 will be enabled.

Host controller 110 can receive image sensor feedback signal 250 from image sensor 145 and/or audio sensor feedback signal 360 from audio sensor 150 and can determine whether image sensor 145 and/or audio sensor 150 are in an on state or in an off state as described above with respect to FIG. 2. In addition, host controller 110 can determine if light source 220 is in an illuminated state or in an unilluminated state based on light source output voltage 225 shown in FIG. 2. If host controller 110 determines that image sensor 145 is in the on state (i.e., based on image sensor feedback signal 250) and that light source 220 is in the unilluminated state (e.g., based on light source output voltage 225), host controller 110 may determine that image sensor 145 has been enabled in a compromised state. Similarly, if host controller 110 determines that audio sensor 150 is in the on state (i.e., based on audio sensor feedback signal 360) and that light source 220 is in the unilluminated state, host controller 110 may determine that audio sensor 150 has been enabled in a compromised state. Further, host controller 110 may determine that image sensor 145 is in a compromised state if host controller 110 determines that image sensor 145 is in an off state and light source 220 is in an illuminated state. Additionally, host controller may determine audio sensor 150 is in a compromised state if host controller 110 determines that audio sensor 150 is in an off state and light source 220 is in an illuminated state. Upon determining that either image sensor 145 or audio sensor 150 is in a compromised state, host controller 110 may cause a notification to be displayed to a user of IHS 100 indicating the compromised state as described with respect to FIG. 2 above. In addition, host controller 110 may cause a notification to be displayed to a user of IHS 100 indicating an electrically disabled state as described with respect to FIG. 2 above.

Figure 4:
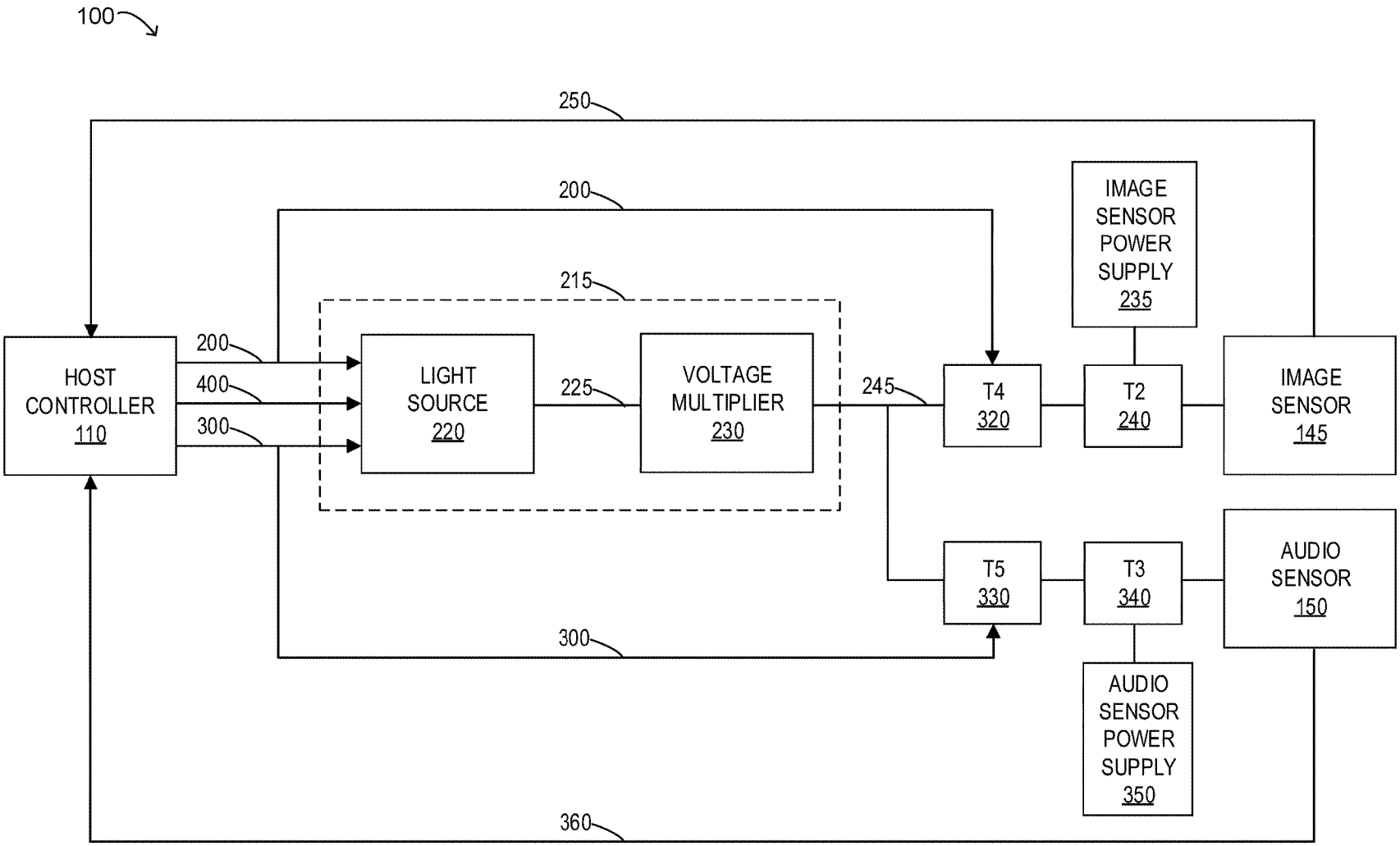
FIG. 4 illustrates a block diagram of selected elements of an embodiment for notifying a user of an information handling system of two sensors in a compromised state using a multi-color light emitting diode (LED).

FIG. 4 illustrates a block diagram of selected elements of an embodiment for notifying a user of an information handling system of two sensors in a compromised state using a multi-color light emitting diode (LED). In the embodiment illustrated in FIG. 4, light source 220 may be a multi-color LED that includes, for example, a red LED, a green LED, and a blue LED (not shown). In one embodiment, light source 220 may illuminate each color LED individually or in combination to indicate a state associated with image sensor 145 and/or audio sensor 150. In one instance, host controller 110 may send image sensor enable signal 200 to image sensor 145 via a green LED of light source 220, causing emission of a green indicator to a user that a camera of IHS 100 has been enabled to begin recording, or otherwise detecting, digital images of the user and/or the environment of the user. In a similar instance, host controller 110 may send audio sensor enable signal 300 to audio sensor 150 via a blue LED of light source 220, causing emission of a blue indicator to the user that a microphone of IHS 100 has been enabled to begin recording, or otherwise detecting, digital audio from the user and/or the environment of the user. In yet another instance, host controller 110 may send an image sensor enable signal 200 and/or an audio sensor enable signal 300 via a red LED, green LED, and blue LED, causing emission of a white indicator to a user that a camera of IHS 100 and/or a microphone of IHS 100 has been enabled, for example. In other embodiments, light source 220 may be an incandescent light source, a fluorescent light source, a combination of light sources described above, or any other light source suitable for notifying a user that a sensor has been enabled.

In the embodiment illustrated in FIG. 4, light source 220 may also include a red LED to indicate a compromised state to a user. In particular, if host controller 110 determines that image sensor 145 and/or audio sensor 150 is/are in the on state (e.g., based on image sensor feedback signal 250 and/or audio sensor feedback signal 360, respectively) and that each color LED of light source 220 is in an unilluminated state, host controller 110 may determine that image sensor 145 and/or audio sensor 150 is/are in a compromised state. Upon determining a compromised state, host controller 110 can send a light source control signal 400 to a red LED of light source 220, causing emission of a red indicator to a user that a camera of IHS 100 and/or a microphone of IHS 100 has been enabled in a compromised state. As shown in FIG. 4, light source control signal 400 may not be electrically coupled to a gate of T4 320 or T5 330. Therefore, light source control signal 400 does not cause a current of light source circuit output voltage 245 to be sent through T4 320 or T5 330 and does not enable image sensor 145 or audio sensor 150. Rather, light source control signal 400 may simply cause a red LED to be in an illuminated state to notify the user that image sensor 145 and/or audio sensor 150 is/are enabled in a compromised state. Host controller 110 may then further cause notification to be displayed to the user (e.g., via a display of IHS 100) indicating that image sensor 145 and/or audio sensor 150 is/are in a compromised state as described above with respect to FIG. 2. In addition, host controller 110 may cause a notification to be displayed to a user of IHS 100 indicating an electrically disabled state as described with respect to FIG. 2 above.

In one embodiment, host controller 110 may receive a request from a third-party application executing on IHS 100 to access, or otherwise utilize, image sensor 145 and/or audio sensor 150. In one embodiment, host controller 110 may refrain from sending image sensor enable signal 200 to image sensor 145 upon receiving the request. Similarly, host controller 110 may refrain from sending audio sensor enable signal 300 to audio sensor 150 upon receiving the request. Rather, host controller 110 may send light source control signal 400 to notify a user of IHS 100 of the request from the third-party by causing a color LED in light source 220 to be in an illuminated state. In one embodiment, host controller 110 may cause a color LED to flash, thereby alternating between an illuminated state and an unilluminated state in response to receiving a request for image sensor 145 and/or audio sensor 150. Therefore, light source control signal 400 may notify a user of IHS 100 that image sensor 145 and/or audio sensor 150 have been requested for use by a third-party application. In one embodiment, host controller 110 may additionally cause a notification to be displayed to a user of IHS 100 indicating to the user that image sensor 145 and/or audio sensor 150 have been requested for use by a third-party application and are in a requested state.

Figure 5:
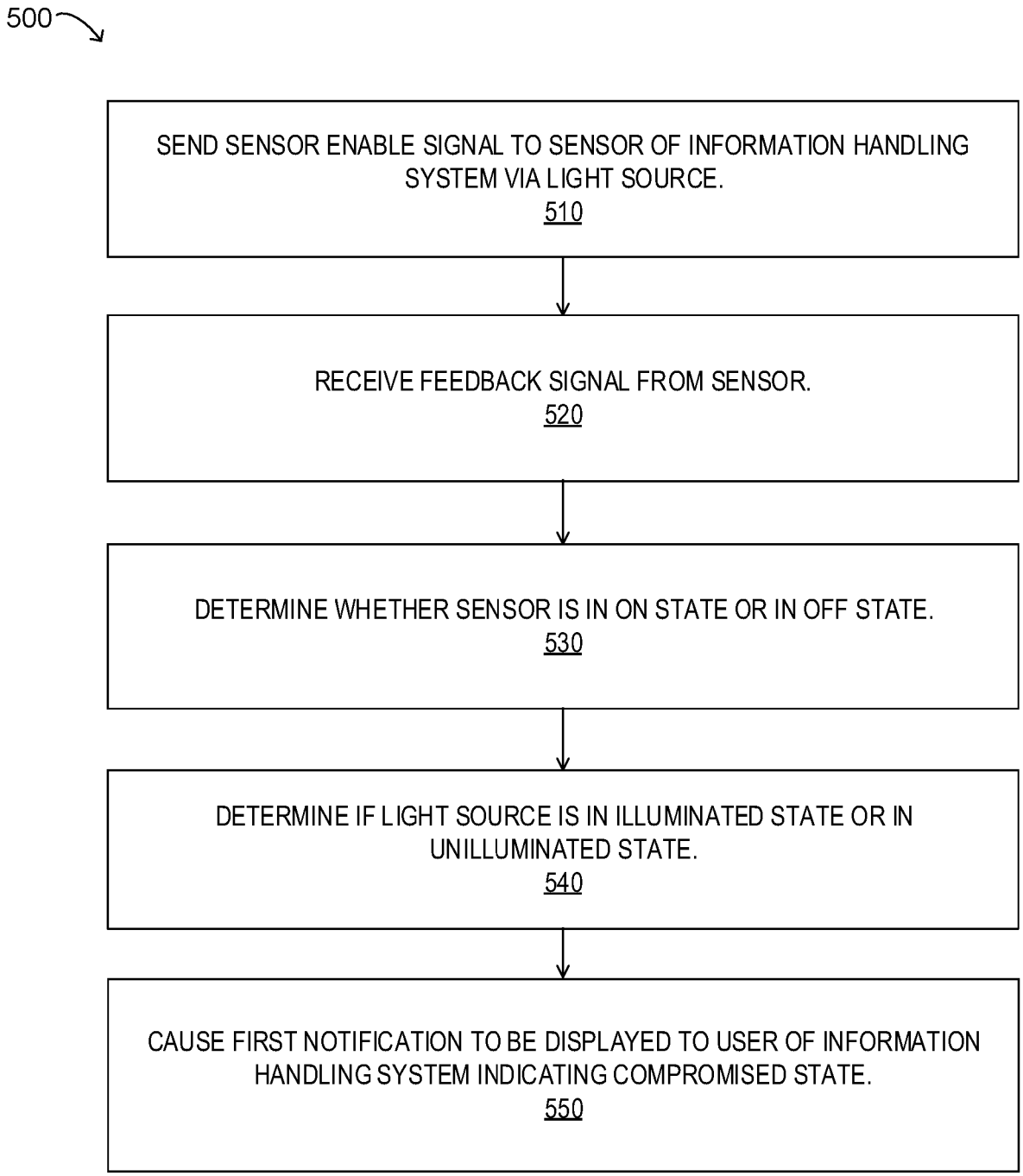
FIG. 5 illustrates a flowchart of selected elements of an embodiment of a method for notifying a user of an information handling system of a sensor in a compromised state.

FIG. 5 illustrates a flowchart of selected elements of an embodiment of a method for notifying a user of an information handling system of a sensor in a compromised state. It is noted that certain operations described in method 500 may be optional or may be rearranged in different embodiments.

In the method 500 illustrated in FIG. 5, a host controller 110 can send 510 a sensor enable signal to a sensor of an information handling system (IHS) 100 via a light source 220, where the light source 220 electrically couples the host controller 110 to the sensor. The host controller 110 can receive 520 a feedback signal from the sensor indicating whether the sensor is in an on state or in an off state. The host controller 110 can determine 530 whether the sensor is in the on state or in the off state based on the feedback signal and can determine 540 whether the light source 220 is in an illuminated state or in an unilluminated state. In response to determining that the sensor is in the on state and that the light source 220 is in the unilluminated state, the host controller 110 can cause 550 a first notification to be displayed to a user of the IHS 100, where the first notification indicates to the user that the sensor is in a compromised state.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A method comprising:

sending, by a host controller, a sensor enable signal to a sensor of an information handling system via a light source, the light source electrically coupling the host controller to the sensor;

receiving, by the host controller, a feedback signal from the sensor, the feedback signal indicating whether the sensor is in an on state or in an off state;

determining, based on the feedback signal, whether the sensor is in the on state or in the off state;

determining whether the light source is in an illuminated state or in an unilluminated state; and in response to determining that the sensor is in the on state and that the light source is in the unilluminated state:

causing a first notification to be displayed to a user of the information handling system, the first notification indicating to the user that the sensor is in a compromised state.

2. The method of claim 1, further comprising:

in response to determining that the sensor is in the off state and that the light source is in the illuminated state, causing the first notification to be displayed to the user of the information handling system.

3. The method of claim 1, wherein the compromised state comprises at least one of:

a state in which the sensor is in the on state and the light source is in the unilluminated state; and a state in which the sensor is in the off state and the light source is in the illuminated state.

4. The method of claim 1, further comprising:

causing, by the host controller, the sensor to be in an electrically disabled state; and causing a second notification to be displayed to the user of the information handling system, the second notification indicating to the user that the sensor is in the electrically disabled state.

5. The method of claim 1, further comprising:

receiving, by the host controller, a request from a third-party application to access the sensor, the third-party application executing on the information handling system; and in response to receiving the request from the third-party application:

refraining from sending the sensor enable signal to the sensor;

sending a light source control signal to the light source, the light source control signal causing the light source to be in the illuminated state; and causing a third notification to be displayed to the user of the information handling system, the third notification indicating to the user that the sensor is in a requested state.

6. The method of claim 1, wherein the sensor of the information handling system is at least one of:

an image sensor; and an audio sensor.

7. The method of claim 1, wherein the light source comprises a multi-color LED, and wherein each color of the multi-color LED indicates at least one of:

the sensor is in the on state;

the sensor is in the compromised state;

the sensor is in an electrically disabled state; and the sensor is in a requested state.

8. The method of claim 1, wherein the host controller and the sensor are electrically coupled in series with the light source.

9. The method of claim 1, further comprising:

causing, via a network of a computing environment, the first notification to be displayed to an administrator of the computing environment; and in response to causing the first notification to be displayed to the administrator:

receiving, from the administrator, a second notification indicating that the sensor is in an electrically disabled state; and causing the second notification to be displayed to the user of the information handling system.

10. A system comprising a processor having access to memory media storing instructions executable by the processor to perform operations comprising:

sending, by a host controller, a sensor enable signal to a sensor of an information handling system via a light source, the light source electrically coupling the host controller to the sensor;

receiving, by the host controller, a feedback signal from the sensor, the feedback signal indicating whether the sensor is in an on state or in an off state;

determining, based on the feedback signal, whether the sensor is in the on state or in the off state;

determining whether the light source is in an illuminated state or in an unilluminated state; and in response to determining that the sensor is in the on state and that the light source is in the unilluminated state:

causing a first notification to be displayed to a user of the information handling system, the first notification indicating to the user that the sensor is in a compromised state.

11. The system of claim 10, further comprising:

in response to determining that the sensor is in the off state and that the light source is in the illuminated state, causing the first notification to be displayed to the user of the information handling system.

12. The system of claim 10, wherein the compromised state comprises at least one of:

a state in which the sensor is in the on state and the light source is in the unilluminated state; and a state in which the sensor is in the off state and the light source is in the illuminated state.

13. The system of claim 10, further comprising:

causing, by the host controller, the sensor to be in an electrically disabled state; and causing a second notification to be displayed to the user of the information handling system, the second notification indicating to the user that the sensor is in the electrically disabled state.

14. The system of claim 10, further comprising:

receiving, by the host controller, a request from a third-party application to access the sensor, the third-party application executing on the information handling system; and in response to receiving the request from the third-party application:

refraining from sending the sensor enable signal to the sensor;

sending a light source control signal to the light source, the light source control signal causing the light source to be in the illuminated state; and causing a third notification to be displayed to the user of the information handling system, the third notification indicating to the user that the sensor is in a requested state.

15. The system of claim 10, wherein the sensor of the information handling system is at least one of:

an image sensor; and an audio sensor.

16. The system of claim 10, wherein the light source comprises a multi-color LED, and wherein each color of the multi-color LED indicates at least one of:

the sensor is in the on state;

the sensor is in the compromised state;

the sensor is in an electrically disabled state; and the sensor is in a requested state.

17. The system of claim 10, wherein the host controller and the sensor are electrically coupled in series with the light source.

18. The system of claim 10, further comprising:

causing, via a network of a computing environment, the first notification to be displayed to an administrator of the computing environment; and in response to causing the first notification to be displayed to the administrator:

receiving, from the administrator, a second notification indicating that the sensor is in an electrically disabled state; and causing the second notification to be displayed to the user of the information handling system.

19. A non-transitory computer-readable medium storing software comprising instructions executable by one or more computers which, upon such execution, cause the one or more computers to perform operations comprising:

sending, by a host controller, a sensor enable signal to a sensor of an information handling system via a light source, the light source electrically coupling the host controller to the sensor;

receiving, by the host controller, a feedback signal from the sensor, the feedback signal indicating whether the sensor is in an on state or in an off state;

determining, based on the feedback signal, whether the sensor is in the on state or in the off state;

determining whether the light source is in an illuminated state or in an unilluminated state; and in response to determining that the sensor is in the on state and that the light source is in the unilluminated state:

causing a first notification to be displayed to a user of the information handling system, the first notification indicating to the user that the sensor is in a compromised state.

20. The non-transitory computer-readable medium of claim 19, wherein the host controller and the sensor are electrically coupled in series with the light source.

* * * * *